United States Patent [19]

Adams

[11] 4,147,118

[45] Apr. 3, 1979

[54] COMBINED ELECTRONIC AND MECHANICAL PATTERN CONTROL FOR A SEWING MACHINE

[75] Inventor: Kenneth D. Adams, Madison, N.J.

[73] Assignee: The Singer Company, New York, N.Y.

[21] Appl. No.: 851,072

[22] Filed: Nov. 14, 1977

[51] Int. Cl.[2] ..... D05B 3/04
[52] U.S. Cl. ..... 112/158 E
[58] Field of Search ..... 112/158 E, 158 B, 203, 112/215, 220, 158 D

[56] References Cited

U.S. PATENT DOCUMENTS

| | | | |
|---|---|---|---|
| 3,585,876 | 6/1971 | Marsh | 112/158 B X |
| 3,698,334 | 10/1972 | Kleinschmidt et al. | 112/220 |
| 3,855,956 | 12/1974 | Wurst | 112/158 E |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A sewing machine wherein the needle stitch position coordinates are controlled electronically is provided with mechanical means for controlling feed stitch position coordinates, and with means for prescribing combined needle stitch position and feed stitch position coordinates enabling various predetermined patterns to be produced on the machine.

4 Claims, 4 Drawing Figures

COMBINED ELECTRONIC AND MECHANICAL PATTERN CONTROL FOR A SEWING MACHINE

BACKGROUND OF THE INVENTION

Electronically controlled sewing machines of the type using electronic logic to control the sewing instrumentalities, such as, for example, the needle mechanism and the feed control mechanism, are in and of themselves known in the art. See, for example, U.S. Pat. No. 3,855,956, issued Dec. 24, 1974, and U.S. Pat. No. 3,984,745, issued Oct. 5, 1976, both of which are assigned to the same assignee as the present invention. Machines of this type have gained a relatively rapid and popular acceptance in the market place and have many desirable features.

Machines having cam controlled feed mechanisms wherein feed stitch position coordinates are provided mechanically through a cam and a cam follower regulating the extent and direction of feed, are also well known in the art. See for example, U.S. Pat. No. 3,585,876, issued July 22, 1971, and U.S. Pat. No. 3,636,900, issued June 25, 1972, both of said patents also being assigned to the same assignee as the present invention. Such cam controlled feed mechanisms have proven to be desirable in that they are relatively durable and are able to absorb the variable feed back forces generated by fabrics of different thicknesses and densities which may be sewn on the machine and thereby prevent such forces from having a deleterious effect on the operation of the feed mechanism. Also, with respect to manually selectable cam controlled feed mechanisms, the feature of being able to manually select some feeding features is desirable.

It is an object of the present invention to provide an improved sewing machine which has incorporated therein the desirable features of the electronically controlled needle position coordinates and which has a manually selectable cam controlled feed mechanism with the advantages enumerated above. A combination of this type, results in a machine which has a very durable mechanism in the area wherein durability is desired and an electronic automatic mechanism wherein accuracy and intricacy of control is desired. In accordance with the invention means are provided enabling an operator to selectably combine cam controlled feed patterns with any one of the electronically controlled needle patterns to produce a variety of stitch patterns. Other objects and advantages of the invention will be best understood when reading the following detailed description with the accompanying drawings wherein:

DETAILED DESCRIPTION OF THE PREFERRED EMBODIMENT

Figure 1:
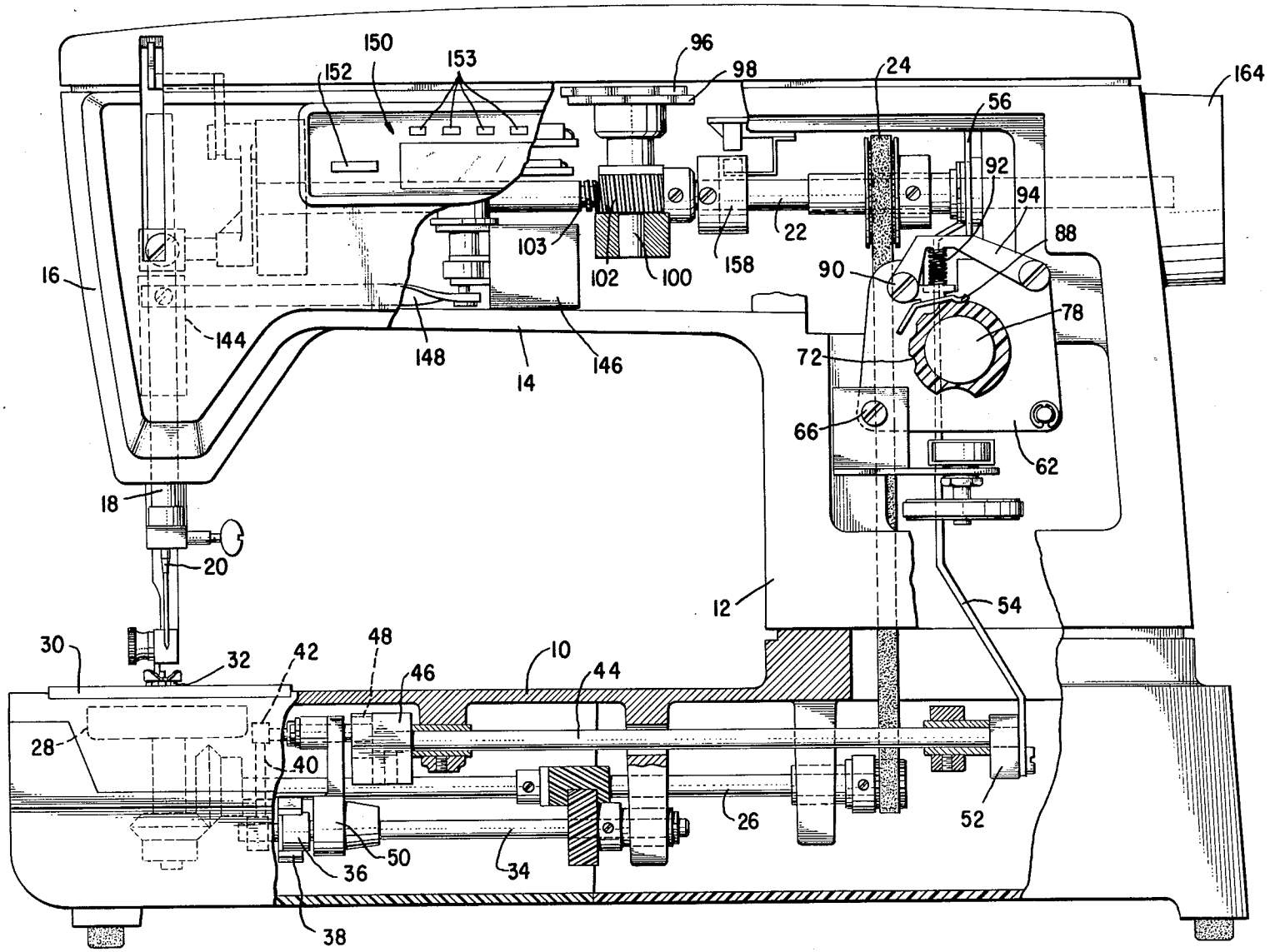
FIG. 1 is a front elevational view of a sewing machine incorporating the present invention with portions of the machine broken away for purposes of illustration.

With reference to the drawings, there is shown in FIG. 1 a sewing machine including a bed portion 10 from which arises a standard 12 connected to an arm portion 14 overhanging the bed 10 and terminating in a head portion 16. Included in the head portion 16 is a needle bar 18 suitably supported for endwise reciprocation in the head portion 16 and including at one end thereof a needle 20. An arm shaft 22 is disposed in the arm portion of the machine and is suitably connected to the needle bar for initiating endwise reciprocating motion thereof. A drive belt 24 is connected between the arm shaft 22 and a looper or hook drive shaft 26 for driving a rotary hook 28 in timed relationship with the reciprocating needle 20 for concatenating the threads to form stitches in a fabric fed across the throat plate portion 30 by a feed dog 32, as will be described more fully hereinafter. As is usual in sewing machines, an electric motor is operably connected to the arm shaft 22 for driving the needle bar in its reciprocating motion and to the hook shaft 26 for rotating the hook 28.

The hook drive shaft 26 has drivingly connected thereto by gears, as illustrated, a feed drive shaft 34 which has at its end adjacent the hook 28, a cam 36. The cam 36 has a pitman 38 operably connected therewith, which in turn is connected to suitable linkage generally designated at 40, for transmitting motion from the pitman 38 to a feed dog drive bar 42 which is connected to the feed dog 32 to initiate lift motion to said feed dog 32 so that the feed dog may raise and lower during the feeding cycle.

Also supported in the bed portion 10, for rotation relative thereto, is a feed regulator shaft 44, which has fixed at one end thereof near the feed mechanism, a feed regulator block 46 in which is disposed a guideway slidably receiving a slide block 48. The slide block 48 is connected to a pitman 50 which is drivingly received at one end thereof on the feed drive shaft 34 and has its other end connected to the drive bar 42. During rotation of the feed drive shaft 34, motion is imparted to the drive bar 42 and feed dog 32 through the pitman 50, and the direction and extent of the movements of the feed dog 32 is determined by the inclination of the feed regulator block 46. The mechanism thus far described is well known in the sewing machine art and reference may be had to U.S. Pat. No. 3,593,769, assigned to the same assignee as the present invention. In order to control the feed regulator block 46 and thereby the operation of feed dog 32, a feed mechanism control system is provided as will now be described.

Figure 2:
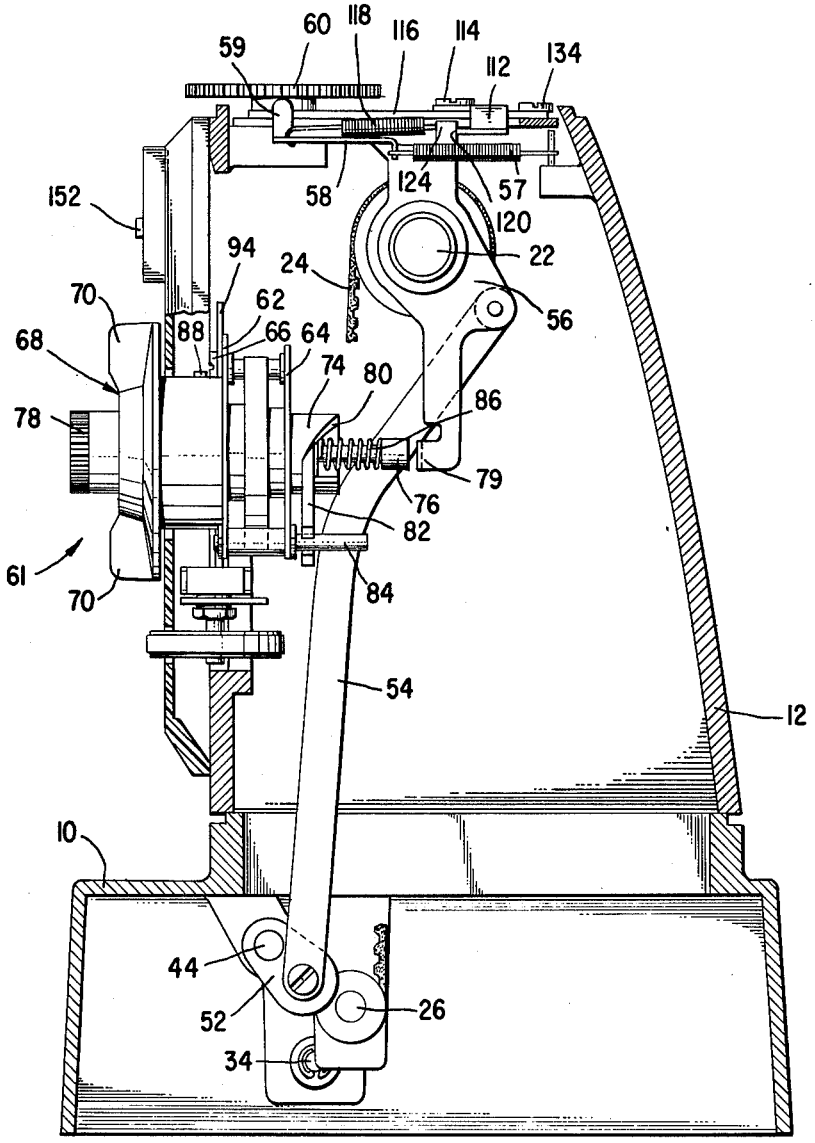
FIG. 2 is an end view of the machine taken from the right hand end of FIG. 1 with a portion thereof cut away to illustrate mechanism inside the machine.
Figure 3:
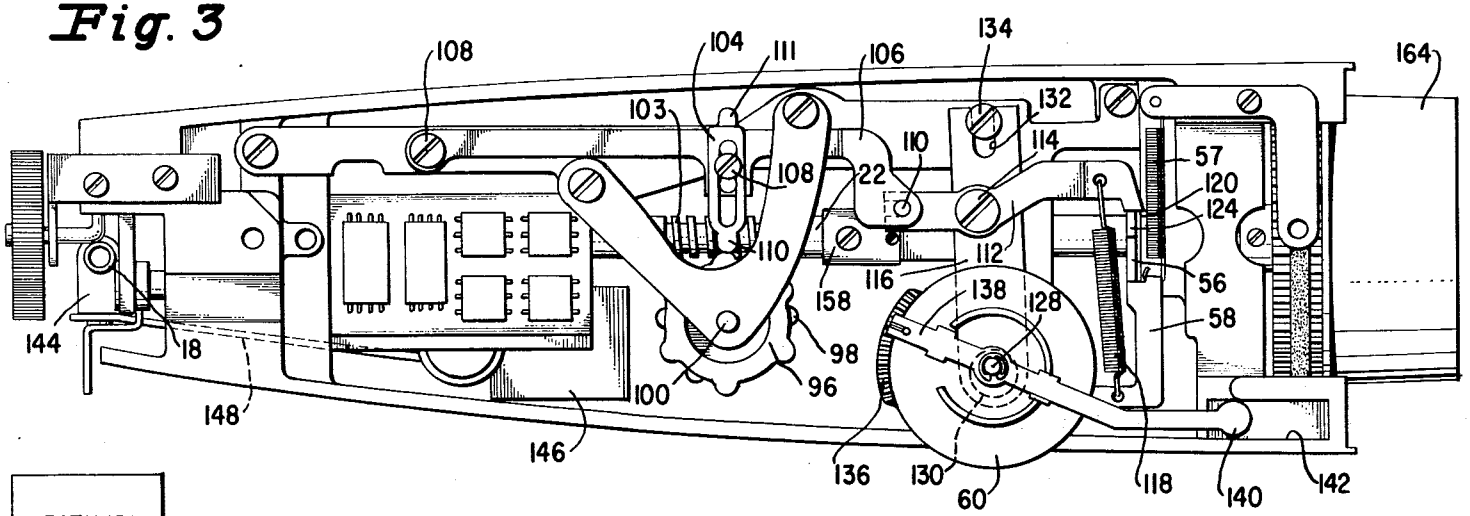
FIG. 3 is a top plan view of the machine with the top cover removed to illustrate the mechanism therein.

As shown in FIGS. 1 and 2, a crank member 52 is fixed to one end of the feed regulator shaft 44 and has a link member 54 pivotally connected thereto. The link member 54, extends upwardly from the bed of the machine through the standard and up into the arm where it is pivotally connected to a plate member 56 which is rotatably mounted on arm shaft 22. Rotational positions are determined for plate member 56 as hereinafter described, and the plate member in accordance with its position and by reason of its connection through link member 54, crank member 52, and regulator shaft 44 with feed regulator block 46 serves to regulate the direction and extent of movements of feed dog 32.

The plate member 56 is biased in a clockwise direction, as viewed in FIG. 2, by a spring 57 having one end connected to a flange 58 on member 56 and the other end connected to the frame of the sewing machine. A stop 59 engagable with the underside of a dial 60 defines a limiting position for plate member 56 and thereby a forward feed of the maximum length possible. Movement of the plate member 56 in a counterclockwise direction into new positions results in a shortening of the length of forward feed possible, until zero, and then reverse feed is attained.

The feed mechanism control system includes a feed selector 61 by means of which an operator may manually control feed. As shown in FIG. 2, the manually operable feed selector 61 is supported in spaced plates 62 and 64 through which screws 66 pass for connection to the machine frame. The feed selector includes a selector dial 68 having finger engagable portions 70 thereon, a ratchet-like cylindrical portion 72 and an axially extending cylindrical portion 74 of lesser diameter than portion 72. Selector dial 68 has an axial bore extending therethrough in which a plunger 76 is disposed. The plunger 76 is connected to a knob 78 and is movable therewith. If an operator wishes to go from forward to reverse feed at any time he need only depress knob 78 whereupon the plunger 76 is moved axially to the right as viewed in FIG. 2 to engage a finger 79 on plate member 56 and move plate member 56 counterclockwise into a position resulting in reverse feed motion of feed dog 32.

The feed selector 61 may also be used to prescribe feed length. As shown, cylindrical portion 74 of the feed selector is provided with a cam track 80 at one end thereof. A cam follower 82 is disposed in engagement with the cam track 80 and is slidably supported on a pin 84 extending through the plates 62 and 64. The portion of the cam follower which in engagement with the cam track 80 also surrounds the reduced shaft portion of the plunger 76 so that when selector dial 68 is turned the cam follower 82 is moved by the track 80 is a direction parallel to the axis of the plunger 76. A spring 86 disposed in surrounding engagement with the reduced portion of the plunger shaft acts against the head of the plunger as well as the cam follower, and causes the plunger 76 to follow the motion of the cam follower 82. In operation, when dial 68 is turned to positions which may be indicated on its face by numbers or the like, and plunger 76 is positioned accordingly as described, plate member 56 is pivoted into feed length prescribing positions defined by the engagement of finger 79 on the plate member with the plunger.

In addition, an operator may use the feed selector 61 to sequentially select the feeds required for a particular purpose, such as for a buttonhole, by moving the selector dial 68 into discrete positions defined by a ratchet-like mechanism now to be described. As may be seen in FIG. 1 the ratchet-like cylindrical portion 72 of feed selector 61 is engaged by a finger member 88. Such finger member is connected by a screw 90 to support plate 62 and is biased against ratchet 72 by a spring 92 disposed between the finger member and a fixed plate member 94. As selector dial 68 is rotated it therefor has the discrete positions already mentioned as controlled by the detent mechanism consisting of the finger member 88 and ratchet-like portion 72. The discrete positions of the dial 68 define particular positions for plate member 56 and determine corresponding feeds accordingly.

The feed mechansim control system includes in addition to the manually operable feed selector, camming and cam follower means which an operator can render effective to automatically control the motion of plate member 56 and thereby feed dog 32, and which he can disconnect when he wishes to manually control feed. The camming comprises one or more cams such as cams 96 and 98 secured to a shaft 100 having affixed thereto a gear 102 which is driven by a worm gear 103 on shaft 22 so that the cams are rotated in timed relationship with the arm shaft 22. The cam follower means is the cam follower 104 which is secured to a link 106 with a screw 108 and has tongues 110 and 111 in the planes of cam 96 and 98 respectively. As shown, the cam follower is secured on link 106 with tongue 110 opposite cam 96 but alternatively it may be secured with tongue 111 opposite cam 98 for engagement therewith.

Link 106 has one end pivoted at 108 to the frame of the machine and has its opposite end pivotally connected at 110 to an intermediate link member 112 which itself is pivotally connected at 114 intermediate its ends to a slidable plate 116. The link 112 has connected thereto a spring 118 which at its opposite end is connected to flange 58 on plate member 56. Such spring ensures engagement of end finger portion 120 of the link 112 with an end finger portion 124 at the top portion of plate member 56.

Cam 96 and cam follower 104 may be rendered effective or ineffective to automatically control feed with control dial 60 which is affixed to a shaft 128 having a cam 130 thereon that is disposed in an opening in slide plate 116. As shown the slide plate includes a slot 132 in which there is disposed a screw 134 for guiding the plate 116 so that an operator by rotating the dial can cause the plate to be moved axially by cam 130 and cam follower 104 which is connected to the plate through links 112 and 106 to be moved into and out of a cooperating position with cam 96. When dial 60 is positioned as required to prescribe automatic cam control of the feed, selector dial 68 should be moved into the maximum feed length position to avoid interference of plunger 76 with plate member 56.

During operation of the machine, cam 96 is rotated in a clockwise direction, and assuming cam follower 104 has been positioned by dial 60 to cooperate with the cam, the cam follower is actuated whenever it is contacted by a raised portion of the cam. As a consequence link 106 is pivoted in a counterclockwise direction to initiate clockwise pivotal movement of the intermediate link member 112 which through finger portions 120 and 124 of the link 112 and plate member 56 respectively, causes counterclockwise rotation of the plate member 56 whereupon the link member 54 is raised to rotate the feed regular block in a direction for initiating reverse feed motion. In order to provide a relatively fine control enabling an operator to equalize forward and reverse feed motion which may become unbalanced from the time to time as different materials are sewed or other factors effect the mechanism, a ratchet-like mechanism is provided comprising an arcuate ratchet portion 136 on dial 60 and a spring-like detent member 138 one end of which engages the ratchet portion 136 when cam follower 104 is with the cam engagable range. As shown the detent member 138 overlies dial 60 and has an enlarged head end 140 disposed in a guide slot 142 which serves to maintain the detent member in a fixed position relative to the ratchet 136 as dial 60 is rotated.

The invention contemplates the use of an electronically controlled bight control mechanism or a needle jogging mechanism. The mechanism for initiating lateral jogging movement of the needle bar 18 is of a type known in the art and may comprise in general a needle bar gate 144 (FIG. 1) which is mounted in the sewing machine frame for relative lateral movement and in which is supported the needle bar 18. In order to initiate lateral movement of the needle bar gate 144, an electromagnetic actuator or linear motor 146 is provided and has connected therewith a drive link 148 having its other end pivotally connected to the needle bar gate 144 so that reciprocating movement of the link 148 initiated by the actuator 146 will be transmitted to the gate 144. Reference may be made to U.S. Pat. No. 3,984,745, issued on Oct. 5, 1976, and assigned to the same assignee as the present invention for a more detailed description of the bight actuating means for the needle bar 18.

Figure 4:
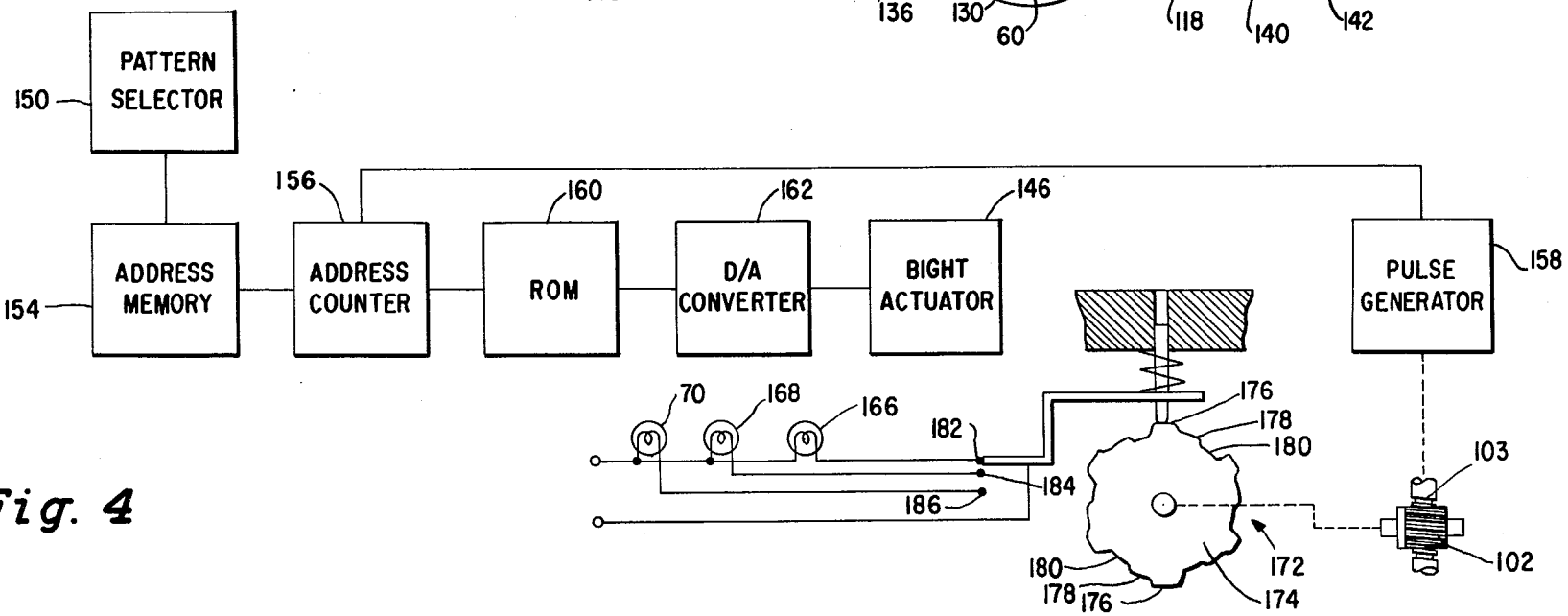
FIG. 4 is a functional block diagram of the electronic control circuitry for the needle mechanism of the machine of the invention.

The electronic control circuit means provided for this invention is shown functionally in the diagram of FIG. 4 and includes a pattern selector 150 enabling the operator to manually select any one of a variety of stitch patterns by depressing a button 152 until a particular window 153 (FIG. 1) indentified with such stitch pattern is illuminated. Although only four windows 153 are illustrated, it should be understood that more or less patterns may be provided as desired in accordance with the capability of the memory of the machine. The pattern selector 150 is connected to an address memory 154 which contains encoded data in binary form to produce a predetermined specific binary number on its output lines for a pattern selected by the operator. The address memory 154 is connected to an address counter 156 which is coupled with a pulse generator 158, physically illustrated in FIG. 1 as being associated with arm shaft 22, so that data from the address memory will be addressed to a pattern read-only-memory 160 (ROM) in timed relationship to the operation of the machine. The pattern read-only-memory has stored therein a stitch position coordinate data for the needle mechanism to produce ornamental needle patterns corresponding to the selections from the pattern selector 150. When the read-only-memory 160 is addressed with particular coded words, pattern information is released and according to the pattern selection is fed to a digital to analogue converter 162 that converts the digital signals from the read-only-memory to analogue signals for use by the bight actuator 146.

A defined phase relationship for the feed mechanism relative to the electronic bight control mechanism which is always addressed at the beginning of a pattern is provided for by an operator manually rotating arm shaft 22 with hand wheel 164 to selectively position a pattern cam with respect to cam follower 104. A particular defined phase relationship which may be one of several possible (three for example for cam 96 shown with a camming surface for respectively providing two forward feeds and one reverse feed in sequence) is obtained by an operator so locating a particular forward or reverse feed controlling surface in any repetitive portion of a pattern cam with respect to cam follower 104 that when sewing is initiated such feed controlling surface is the first to actuate the cam follower. For each needle selected pattern prescribed by the operation of button 152 the pattern which is sewed on the machine depends upon the phase relationship established by the operator with hand wheel 164. With cam 96 three patterns are therefor obtainable for each needle selected pattern prescribable with push-button 152.

The phase relationships are identified for an operator by suitable indicating means such as lamps 166, 168 and 170 (see FIG. 4) provided for use with cam 96, which lamps are controlled by switching means 172 including a cam wheel 174 angularly oriented in a fixed position on shaft 100 with stepped portions 176, 178 and 180 respectively aligned with each of the different feed controlling surfaces on cam 96, and including contacts 182, 184 and 186 operable by the said stepped portions to turn on lamps 166, 168 and 170 respectively.

While the invention has been described in the environment of a preferred embodiment it will be obvious to those skilled in the art that various changes and modifications may be made therein without departing from the spirit and scope of the invention as defined in the appended claims.

Having thus set forth the nature of the invention, what is claimed herein is:

1. In a sewing machine having stitch forming instrumentalities for producing successive stitches in a variety of stitch patterns including a needle supported for endwise reciprocating and relative lateral jogging movements, a work feed means including mechanism for feeding a fabric relative to said needle between needle penetrations, a needle jogging mechanism for initiating relative lateral jogging movement of said needle for producing needle patterns, electric motor means operatively connected to said jogging mechanism and responsive to stitch position coordinate electric signals for initiating relative lateral jogging movement of said needle to stitch position coordinates corresponding to said stitch position coordinate electric signals, static memory means for storing stitch position coordinate data for said jogging mechanism, logic means operable in timed relationship with said machine for selecting and extracting stitch position coordinate data from said memory means, converter means for converting stitch position coordinate data from said memory means into stitch position coordinate signals for operating said electric motor means, operator influenced means connected to said static memory means for selecting a stitch pattern from said memory means such that when a stitch pattern is selected by an operator, the jogging means will initiate relative lateral movement of said needle for reproducing the stitch pattern stored in said memory means, and said work feed means further including cam means having at least one cam with said cam having a cam surface with work feed pattern information contained thereon, cam follower means for transmitting work feed pattern information from such cam to said work feed mechanism, and operator actuable control means for selectively engaging the cam follower means with said cam and enabling an operator to predetermine a defined operating phase relationship between the work feed mechanism and the jogging mechanism.

2. The combination of claim 1 wherein said operator actuable control means includes indicating means operable to define selected positions of the cam follower on said cam.

3. The combination of claim 2 wherein the indicating means is visually observable by the operator.

4. The combination of claim 2 wherein the indicating means includes a plurality of lamps, each operable to define a different selected phase relationship between the work feed mechanism and jogging mechanism.

* * * * *